US006298638B1

(12) United States Patent
Bettle

(10) Patent No.: US 6,298,638 B1
(45) Date of Patent: Oct. 9, 2001

(54) SYSTEM FOR BLOW-MOLDING, FILLING AND CAPPING CONTAINERS

(75) Inventor: Griscom Bettle, Sarasota, FL (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 09/403,265

(22) PCT Filed: Apr. 17, 1998

(86) PCT No.: PCT/US98/07760

§ 371 Date: Oct. 15, 1999

§ 102(e) Date: Oct. 15, 1999

(87) PCT Pub. No.: WO98/47770

PCT Pub. Date: Oct. 29, 1998

Related U.S. Application Data

(60) Provisional application No. 60/044,089, filed on Apr. 21, 1997, and provisional application No. 60/077,085, filed on Mar. 6, 1998.

(51) Int. Cl.[7] ..... B65B 43/00

(52) U.S. Cl. ..... 53/452; 53/467; 53/471; 53/559; 53/284.5

(58) Field of Search ..... 53/452, 149, 141, 53/284.5, 453, 467, 471, 473, 559, 561, 67; 141/372, 373, 271, 272, 171

(56) References Cited

U.S. PATENT DOCUMENTS

| | | | | |
|---|---|---|---|---|
| 2,363,248 | | 11/1944 | Hopkins | 113/14 |
| 2,540,120 | | 2/1951 | Jacobs | 226/75 |
| 2,584,397 | * | 2/1952 | Pitman . | |
| 3,087,353 | | 4/1963 | Krupp | 74/665 |
| 3,336,722 | | 8/1967 | Van Der Winden | 53/37 |
| 3,694,997 | | 10/1972 | Christine et al. | 53/112 R |
| 3,707,823 | | 1/1973 | Guckel | 53/112 R |
| 3,771,576 | * | 11/1973 | Gellatly et al. | 141/150 |
| 3,834,431 | * | 9/1974 | Zittel et al. | 141/131 |
| 3,994,321 | * | 11/1976 | Eisenberg | 141/1 |
| 4,014,158 | | 3/1977 | Rausing | 53/167 |
| 4,099,361 | * | 7/1978 | Dix et al. | 53/201 |
| 4,208,852 | | 6/1980 | Pioch | 53/167 |
| 4,522,011 | * | 6/1985 | Bauers et al. | 53/55 |
| 4,528,796 | | 7/1985 | Lemaire | 53/268 |
| 4,543,770 | | 10/1985 | Walter et al. | 53/511 |
| 4,721,138 | * | 1/1988 | Simonazzi | 141/150 |
| 4,765,119 | | 8/1988 | Aidlin et al. | 53/308 |
| 4,803,055 | | 2/1989 | Ueda | 422/297 |
| 4,901,504 | | 2/1990 | Tsuji et al. | 53/247 |
| 4,979,347 | | 12/1990 | Shibauchi et al. | 53/167 |
| 4,987,726 | | 1/1991 | Petho et al. | 53/510 |
| 5,054,260 | | 10/1991 | Herzog | 53/307 |
| 5,123,229 | | 6/1992 | Dardaine et al. | 53/426 |
| 5,284,001 | | 2/1994 | Ochs | 53/307 |
| 5,375,395 | | 12/1994 | Gmeiner | 53/493 |
| 5,406,772 | * | 4/1995 | Dinius | 53/67 |
| 5,437,361 | | 8/1995 | Ohmori et al. | 198/465.1 |
| 5,509,524 | | 4/1996 | Ohmori et al. | 198/465.1 |
| 5,791,385 | * | 8/1998 | Stahlecker | 141/171 |
| 5,996,322 | | 12/1999 | Labarre | 53/561 |

FOREIGN PATENT DOCUMENTS

| | | |
|---|---|---|
| 1 237 344 | 1/1970 | (GB) . |

* cited by examiner

*Primary Examiner*—Peter Vo
*Assistant Examiner*—Sam Tawfik
(74) *Attorney, Agent, or Firm*—Howson and Howson

(57) ABSTRACT

A process and apparatus for blow-molding, sterilizing, filling and capping plastic containers under conditions of positive control in a close-coupled, compact machine to enhance operational efficiency.

23 Claims, 3 Drawing Sheets

FIG. 2
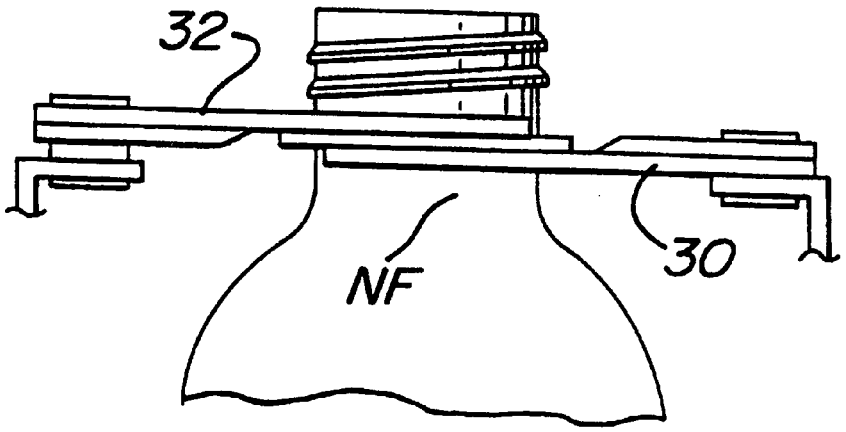
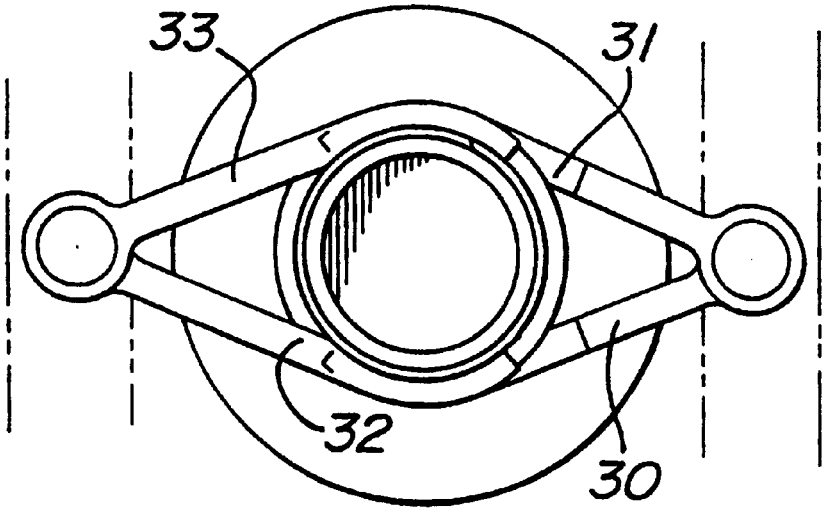
FIG. 2A

SYSTEM FOR BLOW-MOLDING, FILLING AND CAPPING CONTAINERS

CROSS-REFERENCE TO RELATED APPLICATIONS

This is a 371 of PCT/US98/07760, which claims the benefit of the priority of U.S. patent application Ser. No. 60/044,089, filed Apr. 21, 1997 and U.S. patent application Ser. No. 60/077,085, filed Mar. 6, 1998.

The present invention relates to blow-molded plastic containers, and more particularly, the present invention relates to a process and apparatus for continuously blow-molding, filling and capping plastic containers.

BACKGROUND OF THE INVENTION

It is known to manufacture plastic containers for use in the so-called hot fill process by injection molding preforms of plastic, such as PET, and blow-molding the preforms in a mold cavity. After molding, the resulting containers are discharged from the mold and packaged for shipment to another location for filling with a beverage, such as juice at an elevated temperature. After filling, the containers are capped and allowed to cool to ambient temperature for distribution to the ultimate consumer. This same basic process is used for filling with other liquids, edible and inedible, such as salad oil and shampoo. Some of these other liquids are filled at ambient temperature.

It is customary for the preforms to be injection molded at one location and transported to another location where they are blown into containers. At the blowing location, preforms are customarily fed in single file to a feeding mechanism which transfers the preforms to a conveyor which spaces them from one another and advances them in an open loop path through a pre-heat oven. In the pre-heat oven, the preforms are heated to a predetermined temperature by various means, such as radiant heaters. After the preforms are heated to the desired temperature, usually near the glass transition temperature (Tg) of the particular plastic from which the preform is molded, the preform is transferred into a blow-mold cavity. While in the blow-mold cavity, the preform is blown by means of compressed air into the shape of the mold cavity while preferably simultaneously being subjected to axial stretching to effect biaxial orientation of the container, all known in the art. After a brief residence period in the mold, the resulting blown container is discharged from the mold for packing and in the mold, the resulting blown container is discharged from the mold for packing and shipping to another location for filling.

The filling location can be at a completely separate plant location, or can be connected to the blow-molding equipment by means of a belt-type conveyor, such as where the blow-molding occurs at one plant location and filling at another location within the same plant.

It is customary to use belt-type conveyors to move containers from one location to another in a plant, particularly when non-carbonated liquids are involved. In carbonated filling systems, the containers are typically transported by the neck finish. It is also known to use chain-type conveyors in the pre-heat oven to engage the preforms at their neck finishes while they are being heated. Sidel of Le Havre France, manufactures a rotary preform transfer device which grips the preheated preforms about their necks and transfers them into the blow-mold. The device rotates much like a star-wheel, about a vertical axis, but has claw-like gripping elements which grip the preform about its neck finish and advance it in an arcuate path to a like gripper associated with the blow-mold. The gripper on the rotary transfer device is designed to release the preform only after the blow-mold gripper has actually gripped the preform. As a result, the preform is always under positive control as it transits through the pre-heat oven and the blow-mold apparatus. Such apparatus has been found particularly reliable in operation.

In an aseptic filling operation, after the container is blown from a preform, it is discharged from the blow-mold for sterilization, filling and capping. It is conventional practice to load the empty blown containers onto a conveyor belt which transports them to another plant location for sterilizing, filling and capping. At such location, the containers are initially spaced apart on the conveyor by various means, for example a screw-type conveyor for transfer between guide rails to a star-wheel which displaces the containers through various paths that pass through sterilization, filling and capping stations. This equipment is known in the art.

A significant problem with the above approach in the production of filled and capped blow-molded containers resides in the inefficiencies associated with the transfer of empty containers from one conveyor to another. During the transfer process, containers have a proclivity for jamming in the region of the screw conveyor transfer to a guide rail and star-wheel, particularly when empty containers are engaged by their bodies which deform-easily, thereby necessitating a shutdown of the entire line until the jam has been cleared. Considering the high production rates associated with modern container manufacturing and filling operations, shutdowns even as short as one half hour can be costly to the plant operator. Moreover, in an environment wherein containers are also sterilized prior to filling, additional inefficiencies occur because of the need to enter a sterile environment for unclogging a jam, and the time required for re-sterilization.

A common technique for high-speed filling of containers with liquids involves the use of a movable fill nozzle which penetrates the neck of a container and which retracts as filling progresses. With this technique, foaming is minimized, and this expedites accurate filling to a predetermined fill level. While this technique may be satisfactory in the hot-filling of containers, it is not desirable in aseptic filling where it is imperative that the fill nozzle not penetrate the container neck finish in order to maintain sterilization of the container and its contents and to avoid the potential for cross-contamination.

In capping filled containers, caps are normally fed down a chute and picked for application to containers as they move past a capping station. It is known that such equipment has a proclivity for jamming, which can necessitate a shutdown of the entire line to fix the course of the jam. Occasionally, a filled, but uncapped, container exits the capping machine and spills its contents. This necessitates clean up, not to mention loss of product. There have been some attempts to control the application of caps onto containers with some degree of precision in an effort to avoid this problem. However, the effectiveness of such equipment is not known.

In prior art practice, blow-molding systems operate at efficiencies above 95%, while filling/capping systems operate between 70–80%. Economical operation required decoupling these operations. A system is needed to increase the efficiency of filling/capping. This is particularly true with aseptic operations.

In addition to the reliability limitations associated with attempting to integrate disparate items of machinery, often produced by different companies, into an efficient operation, there is the problem of plant space limitations. Apparatus which can blow-mold and cap containers in a minimum of plant floor space is highly desirable both from an efficiency and a capital requirement standpoint.

OBJECTS OF THE INVENTION

With the foregoing in mind, an object of the present invention is to provide a novel process and apparatus for efficiently blow-molding, filling and capping plastic containers.

Another object of the present invention is to provide an improved process and apparatus for handling container preforms from the time they enter the pre-heat oven until after they have been filled and capped.

A further object of the present invention is to provide a unique process and apparatus for blowing, sterilizing, filling and capping containers in a single machine which is jam-resistant which can be changed over to different sizes quickly with minimal loss in efficiency upon restart, and which occupies a minimum of plant floor space.

As another object, the present invention provides an improved process and apparatus for maintaining sterility during filling and minimizing the oxygen uptake of product being filled.

SUMMARY OF THE INVENTION

More specifically, in the process of the present invention, a plurality of preforms are advanced in sequence under positive control while being preheated in a pre-heat oven. The heated preforms are transferred under positive control from the pre-heat oven to a blow-mold where they are blown into containers. The blown containers are discharged from the blow-mold under positive control and, thereafter, are advanced under positive control through filling and capping stations. During filling, the containers are tilted relative to a fill nozzle which remains stationary relative to the container and is maintained above a sterile plane passing through the upper edge of the container finish. Preferably, the blown containers are advanced under positive control through a sterilizing station immediately prior to filling and capping.

BRIEF DESCRIPTION OF THE DRAWINGS

The foregoing and other objects, features and advantages of the present invention should become apparent from the following description, when taken in conjunction with the accompanying drawings, in which:

FIG. 2 is a greatly enlarged, somewhat schematic, view taken on line 2—2 of FIG. 1;

FIG. 2A is a plan view looking downward in FIG. 2; and

DESCRIPTION OF THE PREFERRED PROCESS AND APPARATUS

Figure 1:
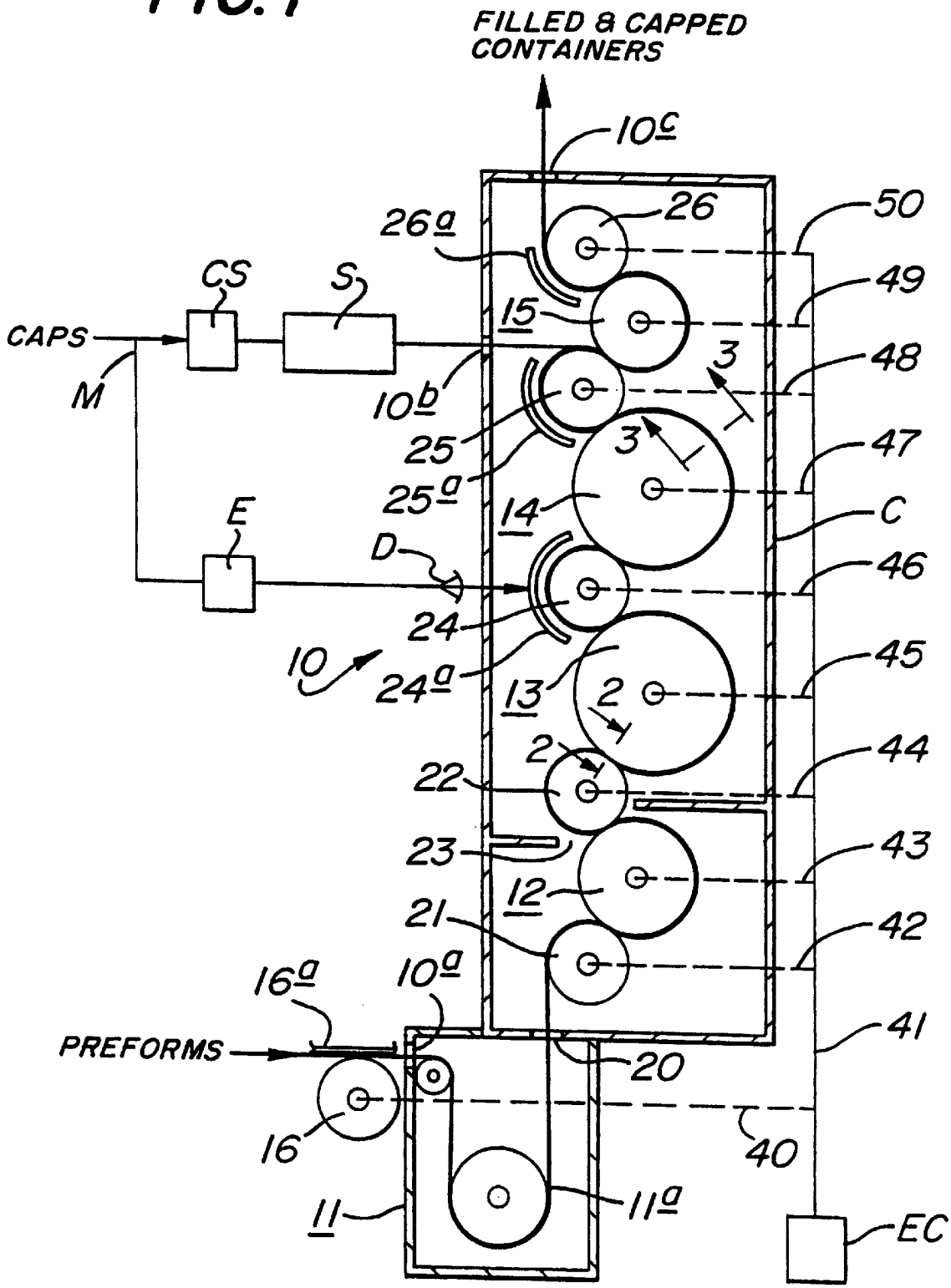
FIG. 1 is schematic diagram illustrating equipment particularly useful in practicing the process of the present invention.

Referring now to the drawings, FIG. 1 illustrates schematically, in plan view, preferred apparatus 10 for practicing the process of the present invention.

As illustrated therein, the apparatus 10 includes a series of work stations disposed in a horizontally-elongate, compact, plant floor plan. The apparatus 10 includes a pre-heat oven 11, a blow-molder 12, a sterilizer 13, a filler 14, and a capper 15 which are close-coupled into an integrated, fully-enclosed unit. As will be discussed, injection molded preforms are admitted into the apparatus 10 at an upstream location 10*a*, (lower left in FIG. 1), and caps are admitted into the apparatus 10 at a downstream location 10*b*, (upper left in FIG. 1) adjacent an exit port 10*c* (top) through which filled and capped containers exit for packaging and transportation to the ultimate consumer.

The pre-heat oven 11 contains a chain-type conveyor 11 a onto which preforms are mounted by means of a star-wheel 16 and guide rail 16*a* and transported in spaced relation in a open-loop path, first in one direction, and then in the opposite direction, toward the blow-molder 12. In the pre-heat oven 11, the preforms are heated by various known techniques, such as radiant heaters, to raise their temperatures to a temperature suitable for blow-molding (eg. the glass transition temperature, Tg). The pre-heat oven 11 is connected to the blow-molder 12 by means of an open aperture 20 through which heated preforms pass.

The preforms are disengaged from the pre-heat oven conveyor 11*a* and transferred to the blow-molder by means of a positive grip transfer wheel 21 disposed between the pre-heat oven conveyor and the blow-molder 12. The heated preform is transferred to a blow-molding wheel which rotates about a vertical axis to blow the preform into the desired shape of the container as the wheel rotates in a counter clockwise direction in the blow-molder 12. Blow-molded containers are discharged from the blow-molder 12 by means of a downstream positive grip transfer wheel 22 like in construction to its companion upstream positive grip transfer wheel 21.

As described thus far, the pre-heat oven 11 and blow-molder 12 are of commercially available design and construction. A preferred pre-heat oven 11 and blow-molder 12 is manufactured by Sidel of Le Havre, France. Blown containers discharged from such a blow-molder 12 have heretofore simply been transferred via conventional conveyors to other locations in a plant for sterilizing, filling, and capping, or packed for shipment to other plant locations.

According to the present invention, the blow-molder 12 is connected directly to a horizontally-elongate cabinet C which contains the sterilizer 13, the filler 14, and the capper 15. The blown containers are transferred under conditions of positive control, not only through the pre-heat oven 11 and blow-molder 12, but also through the downstream sterilizing, filling and capping stations in a common cabinet C which is close-coupled to the blow-molder 12.

To this end, the sterilizing, filling and capping cabinet C is connected to the blow-molder 12 by means of a port 23 through which the blown containers are first transferred to the sterilizer 13. The sterilizer 13 is of a conventional rotary design which utilizes a sterilizing rinse, such as an ozone water rinse to sterilize the interior of the blown containers as they advance in a arcuate path about a vertical axis.

After the container has been sterilized and rinsed, it is transferred from the sterilizer via a positive star-wheel/guide rail system 24, 24*a* to the filler 14 in the cabinet C. The filler 14 is of conventional rotary design. In it, the sterilized containers advance in an arcuate path about a vertical axis where they are sequentially filled to a predetermined level before being discharged and transferred by another positive star-wheel/guide rail system 25, 25*a* to the capper 15 in the cabinet C. The filled containers advance in a arcuate path about a vertical axis in the capper 15 and, after being capped, are discharged by another positive star-wheel/guide rail system 26, 26*a*.

As illustrated in FIG. 1, after the blown containers exit the blow-molder, they advance in a continuous serpentine path through the sterilization, filling and capping stations under conditions of continuous positive control. In the present invention, continuous positive control is effected by gripping the preform about its neck finish by means of a first set of grippers 30, 31 which cooperate with cams and followers (not shown) to release each preform only after a second set of grippers 32, 33 has gripped the preform about its neck finish NF. See FIGS. 2 and 2*a*. The grippers 30—33 are of a claw-like construction and are disposed in spaced relation about the periphery of each positive grip wheel 16, 21, 22, 24, 25 and 26, the blow-molder 12, sterilizer 13, filler 14, and capper 15. The opening and closing of the gripper claws 30–33 and the interaction of meshing star-wheel is synchronized with the rotation of the positive transfer wheels to ensure continuous positive neck finish engagement throughout the blowing, sterilizing, filling and capping operations.

In addition to positive control of the container neck finishes as they advance through the apparatus 10, the present invention contemplates positive control of caps to and into the capping machine 15 in a manner that ensures that a cap is not discharged in the absence of a container to receive it. To this end, a means D is provided to detect the absence of a container neck finish at a particular location after it has come under positive control in the apparatus 10. For example, such a location could be in the pre-heat oven 11, or at some other downstream location, such as illustrated, after positive control of the preform has been effected. After the absence of a container neck finish has been detected at a particular location, it is a straightforward matter to determine by electronic means E when the location reaches the capper 15 and to ensure that a cap is absent at the time a cap would be applied to the absent neck finish. Preferably, this is effected by placing the caps under positive control before the region between their admittance into the cabinet C and placement on the capper 15. This way, the entire machine can be emptied simultaneously. For example, if preforms are stopped at portal 10*a*, caps are correspondingly stopped at point M such that the last preform meets the last cap in capper 15. A cap surge device CS is used between location M and cap sterilizer S in the cap feed line. Positive control can be effected by means of a conveyor wherein each cap is held in a separate pocket with a mechanism M for discharging a cap from a pocket which would overlie the fill location corresponding to the location of the absent neck finish in response to a sensed absent neck finish upstream. This insures that a cap is not discharged in the absence of a blown container for receiving the cap in the capper 15. The advantage of this is not only to reduce the loss of caps, but also to ensure the absence of loose caps which may jam mechanisms and result in a shutdown of the entire system.

The various items of equipment described, including the pre-heat conveyor, blow-molder, sterilizer, filler and capper may be driven by a common power source through appropriate gearing, or may be driven by separate motors interconnected by means of electrical controls EC designed to synchronize the movement of the various items of equipment. This is indicated schematically in FIG. 1 by reference numerals 40–50.

The cabinet C containing the sterilizer, filler and capper excludes outside, unfiltered air except for the regions through which the blown containers, caps and filled containers enter and exit, respectively. Flowing sterile air passes down through an overhead filter means over the equipment in cabinet C. Appropriate air interlocks can be provided at these locations, such as air curtains at 10*b* and 10*c*, to separate the relatively sterile environment contained within the cabinet C from ambient air. An air curtain is also provided in the port 23 between blow-molder 12 and the cabinet C. Preferably, the entire cabinet C contains clean-in-place spray equipment, known in the art, to wash down the confined equipment at appropriate intervals.

From the foregoing, it should be apparent that the present invention provides an efficient process and apparatus for blowing, sterilizing, capping and filling containers, wherein container preforms, and the containers blown therefrom, are maintained continuously in positive control throughout the entire process from preheating through capping. This is achieved by eliminating non-positive transfer points. In the present invention, positive control is maintained by means which grip each container finish throughout the entire process and advance it in a continuous serpentine path from preheating through capping. By eliminating screw container body gripping via conveyors, linear conveyors, and transfer mechanisms for them, the proclivity to jam is eliminated, and the efficiency of the entire process is significantly enhanced. Efficiency is further enhanced when caps are also maintained under positive control to and through the capper as described. The positive control aspects of the present invention, provide the above advantages even when sterilization is not required, but are particularly desirable when container sterilization is required, since there is no need to break asepsis in order to clear a jam. Blowing, filling and capping systems are often changed over from one size bottle to another. In the prior art, this required changing screw conveyors, star-wheels and adjusting guide rails. If the adjustment was not perfect, jams occurred on restart. Since the positive transfer occurs at the unchanging neck finish NF, a size changeover merely requires changing the blow-molds and restarting machine 10. This further increases overall efficiency which is of particular importance in aseptic operations.

As used herein, the term container is intended to encompass bottles, jars and like receptacles for containing fluent materials.

In aseptic filling of a container with a sterilized liquid, it is imperative that the filling nozzle discharge port not break a sterile fill plane which passes across the upper end of the container finish perpendicular to the central longitudinal axis of the container. The reason for this requirement is that penetration by the filling nozzle discharge port can compromise the sterility of the filled container due to the possibility that microorganisms on the nozzle could be transferred to the inside of the container finish. Heretofore, it has been conventional practice for fill nozzles to enter the finish and retract as the container fills in order to minimize foaming of the liquid and to speed filling. Such a practice is antithetical to efficient filling of sterilized containers for sterile liquids. Filling foam can transfer potential contamination from bottle to machine to a subsequent bottle. This foam also adds oxygen to the filled product. Some products such as juice and juice drinks develop oxidation off-flavors over time when oxygen is in the juice. These off-flavors shorten shelf life. Thus, by substantially eliminating foaming, product shelf life is extended with obvious economic benefit.

Figure 3:
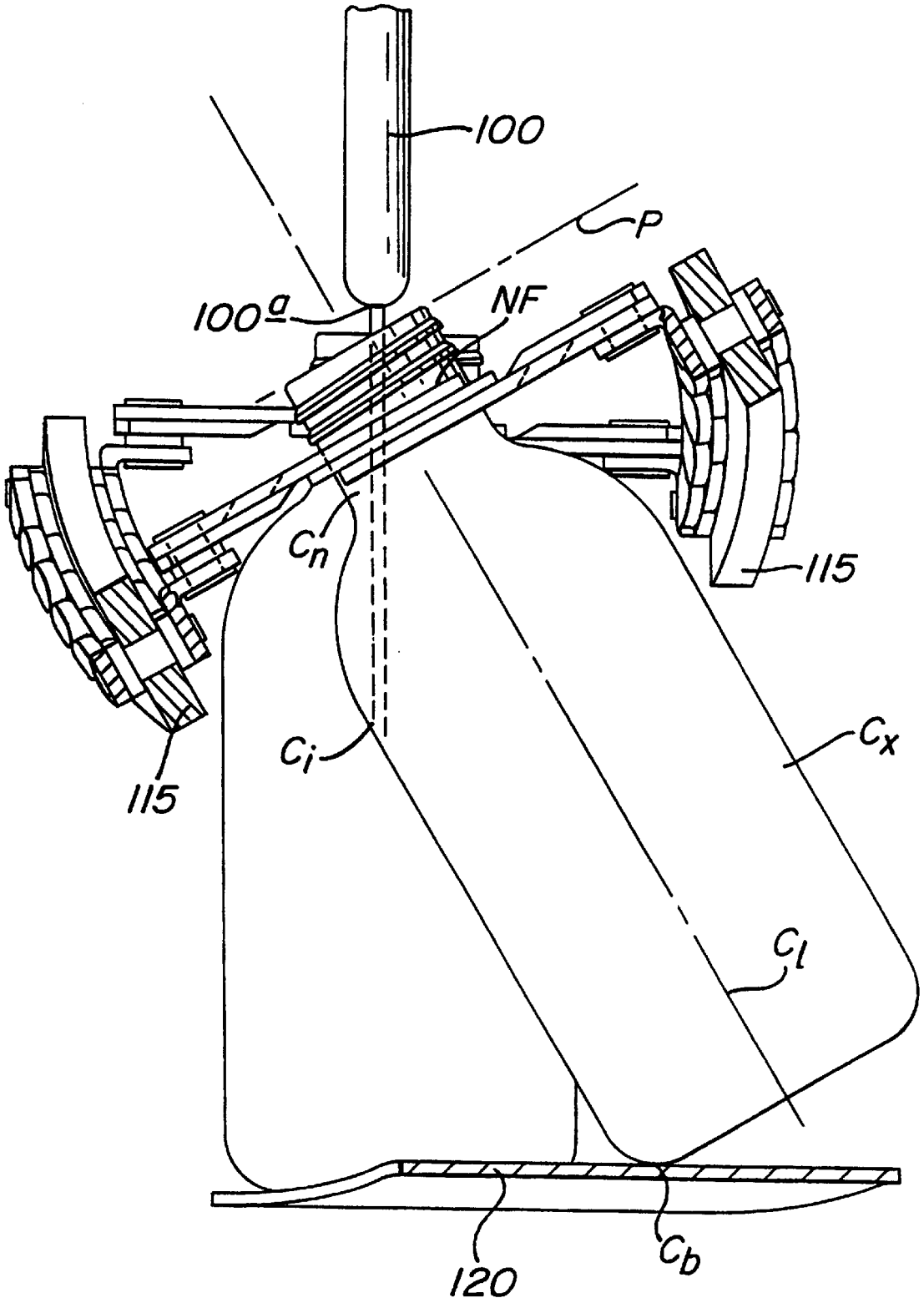
FIG. 3. is an elevational view, in partial section, taken along Line 3—3 of FIG. 1 to illustrate apparatus for container tilting during filling.

The present invention overcomes the stated sterile fill problems and product aeration and enables efficient sterile fill rates to be achieved. To this end, as best seen in FIG. 3, apparatus is provided to tilt a container Cx during filling from a fill nozzle 100 discharge port 100*a* which is maintained above a sterile fill plane P. Preferably, tilting is effected by gripping the container neck finish NF as the container Cx advances into the filling station 14 and, during filling, continuing to advance the gripped tilted container as the container Cx is charged with liquid through its neck finish NF. Preferably, the container Cx advances in an arcuate path in a rotary filling machine 14 which is fitted with inclined tracks 115*a* and 115 that tilt the container base radially outward. A belt-conveyor 120 may be provided along a portion of the path of movement of the container Cx for engaging and supporting the container base Cb after it has been at least partially filled in order to relieve some loads on the gripped container neck Cn. Also, preferably, the fill nozzle discharge port 100*a* is offset from the central longitudinal axis CL of the container Cx, preferably radially inward of the path of movement of the containers in the filler 14, so that the sterile liquid flows toward the tilted inner surface of the container during filling. Throughout the filling process, the fill nozzle is maintained stationary relative to the container neck and is located above the sterile plane P while advancing with the container Cx as it moves. Thus, the liquid is flowed at an acute angle relative to the container central longitudinal axis CL causing it to impinge upon the inside of the container dome and/or sidewall as at Ci before striking the container bottom Cb. As a result, a substantial amount of foam-producing liquid flow energy is dissipated, thereby enabling relatively high fill rates to be achieved without requiring a penetrating-type fill nozzle and, of course, without risking loss of sterility of the container and its filled contents.

In view of the foregoing, it should be apparent that the present invention provides an improved process and apparatus for blowing, filling and capping blow-molded containers in an efficient manner utilizing close coupled equipment that occupies a minimum of plant floor space.

What is claimed is:

1. In a process for efficiently blow-molding, filling and capping, plastic containers blown from pre-forms having a neck finish, including the steps of advancing a plurality of preforms in sequence while pre-heating them in an oven;

transferring the preforms from said pre-heat oven and into a blow-mold; and blowing the preforms into containers in the blow-mold; the improvement comprising:

discharging the blown containers under positive control from said blow-mold; and advancing the containers under positive control while filling the containers and capping the filled containers;

said positive control being effected by gripping said neck finish throughout at least said container discharging and advancing steps;

whereby container preforms and resulting containers are maintained under continuous positive control throughout the entire container manufacturing and filling and capping process.

2. The process according to claim 1 wherein said positive control gripping includes the steps of engaging said neck finish with a first gripper and, before disengaging said first gripper from said neck finish, engaging said neck finish with a second gripper.

3. The process according to claim 1 wherein said preforms and containers blown therefrom move in a continuous serpentine path between said preform pre-heating step and said capping step.

4. The process according to claim 3 wherein said continuous serpentine path lays within a horizontally elongate chamber (C) extending between said blow-molding step location and said capping location.

5. The process according to claim 4 including the step of sterilizing at least the interior of the containers as they advance in said serpentine path in said horizontally elongate chamber (C).

6. The process according to claim 1 including the steps of synchronizing the feed of a closure under positive control to a container finish at a predetermined capping location during said capping step, detecting the absence of a finish at a predetermined location during said aforementioned sequence of steps from preheating to filling, and withholding the feed of a closure to said predetermined capping location in response to said absent finish at said predetermined capping location.

7. The process according to claim 1 wherein, while filling said containers during said advancing step, said containers are tilted for causing filling liquid to enter the container neck without penetrating it and to initiate contact with the container without substantial turbulence.

8. Apparatus for efficiently blow-molding, filling and capping plastic containers blown from pre-forms having a neck finish, comprising:

first means for advancing a plurality of preforms in sequence under positive control while pre-heating them in an oven;

means for transferring, the preforms under positive control from said pre-heat oven and into a blow-mold;

means for blowing the preforms into containers in the blow-mold;

means gripping said neck finish for discharging the blown containers under positive control from said blow-mold; and second means gripping said neck finish for advancing the containers under positive control while filling the containers and capping the filled containers;

whereby container preforms and resulting containers are maintained under continuous positive control throughout the entire container manufacturing and filling and capping process.

9. Apparatus (10) according to claim 8 wherein said positive control is effected by gripping means operable to engage the preform neck finish (NF) continuously throughout said entire process.

10. Apparatus (10) according to claim 9 wherein said gripping means includes a first gripper (30, 31) and a second gripper (32, 33), and means for causing said first gripper (30, 31) to disengage said neck finish (NF) only after said neck finish (NF) is engaged with said second gripper (32, 33).

11. Apparatus (10) according to claim 8 wherein said first means for advancing, said means for transferring, said means for blowing, said means for discharging, and said second means for advancing are disposed in closely spaced tangential relation so that said preforms and containers blown therefrom move in a continuous serpentine path between said preform pre-heating means (11) and said capping means (15).

12. Apparatus (10) according to claim 11 including a horizontally elongate chamber (C) extending between said blow-molding means (12) and said capping means (15) within which said serpentine path is confined.

13. Apparatus (10) according to claim 12 including means for sterilizing at least the interior of the containers as they advance in said serpentine path in said horizontally elongate chamber.

14. Apparatus according to claim 11 wherein said enclosure includes a horizontally elongate chamber adjacent said blow-mold and said means for advancing said blown containers is arranged in a continuous serpentine path in said enclosure.

15. Apparatus (10) according to claim 8 including means for synchronizing the feed of a closure under positive control to a container finish at a predetermined capping location during said capping, means (D) for detecting the absence of a finish at a predetermined location between said pre-heating means (11) and said filling means (14), and means for withholding the feed of a closure to said predetermined capping location in response to said absent finish at said predetermined capping location.

16. Apparatus according to claim 8 including a fill nozzle (100) movable with said containers during filling while remaining stationary above the neck finish (NF), and means operably engaging said neck finish (NF) for tilting said containers relative to said fill nozzle (100) for causing fill fluid to enter the neck finish (NF) at an angle with respect to the longitudinal axis of the container.

17. In an automated blow-molded plastic container filling process wherein containers having necks with finishes are delivered to a filling machine having a fill nozzle with a discharge port for charging the containers with a liquid as they advance in tandem, the improvement comprising the steps of:

sterilizing each container interior, gripping each container by its neck finish for advancing the container in the filling machine, tilting each container as it advances, and while tilted, flowing the liquid into the container through its neck while maintaining the fill nozzle stationary relative to the path of movement of the neck.

18. The process according to claim 17 wherein, during filling, the discharge port (100*a*) of the fill nozzle (100) is maintained above a plane passing through the upper end of the container finish and perpendicular to the central longitudinal axis of the container.

19. The process according to claim 17 wherein, during filling, the fill nozzle discharge port (100*a*) is offset from the central longitudinal axis of the container.

20. The process according to claim 17 wherein, during filling, said container is gripped by its neck finish (NF) and thereby tilted.

21. The process according to claim 17 wherein both said container interior and said liquid are sterilized prior to filling and said filling step is effected without compromising the sterility of the filled container.

22. A process for efficiently filling and capping in a sterile environment plastic containers blown from pre-forms having a neck finish, comprising the steps of:

blowing the preforms into containers in a blow-mold;

discharging the blown containers under positive control from said blow-mold while gripping them by their neck finishes;

introducing said neck finish gripped blown containers into a sterile enclosure; and advancing the containers in said sterile enclosure by gripping them by their neck finishes while filling the containers and capping the filled containers;

whereby containers are maintained under continuous positive control throughout the container sterilization, filling and capping process.

23. Apparatus for efficiently filling and capping in a sterile environment plastic containers blown from pre-forms having a neck finish, comprising:

means for blowing the preforms into containers in a blow-mold;

a sterile enclosure for containing a sterilized gaseous medium adjacent said blow-mold;

means for discharging the blown containers under positive control from said blow-mold and transferring them into said sterile enclosure while gripping them by their neck finishes, and means for gripping said neck finishes while advancing the containers under positive control during filling the containers and capping the filled containers in said sterile enclosure;

whereby containers are maintained under continuous positive control throughout the entire container sterilization, filling and capping process.

* * * * *